United States Patent [19]

Valentino

[11] 4,222,136

[45] Sep. 16, 1980

[54] TRAINING FOOT STOOL

[76] Inventor: Pearl T. Valentino, 846 50th St., D-2, Brooklyn, N.Y. 11220

[21] Appl. No.: 42,986

[22] Filed: May 25, 1979

[51] Int. Cl.[3] ..... A47C 19/22

[52] U.S. Cl. ..... 5/443; 5/507; 182/92

[58] Field of Search ..... 5/443, 507; 297/438, 297/217; 182/92, 150; 248/408; 403/107, 325

[56] References Cited

U.S. PATENT DOCUMENTS

| | | | |
|---|---|---|---|
| 1,325,423 | 12/1919 | Stuart | 182/150 |
| 2,644,961 | 7/1953 | Hillenbrand et al. | 5/507 |
| 2,865,430 | 12/1958 | Folkner | 248/408 |
| 3,078,952 | 2/1963 | Kelling | 182/150 |

*Primary Examiner*—Casmir A. Nunberg

*Attorney, Agent, or Firm*—Richard L. Miller

[57] ABSTRACT

A foot stool which is attachable to a side rail of a sleeping bed, and including a horizontal step plate having two vertically upward legs which, at their upper end, are slideably adjustable inside two hollow hooks that hang over the rail.

1 Claim, 5 Drawing Figures

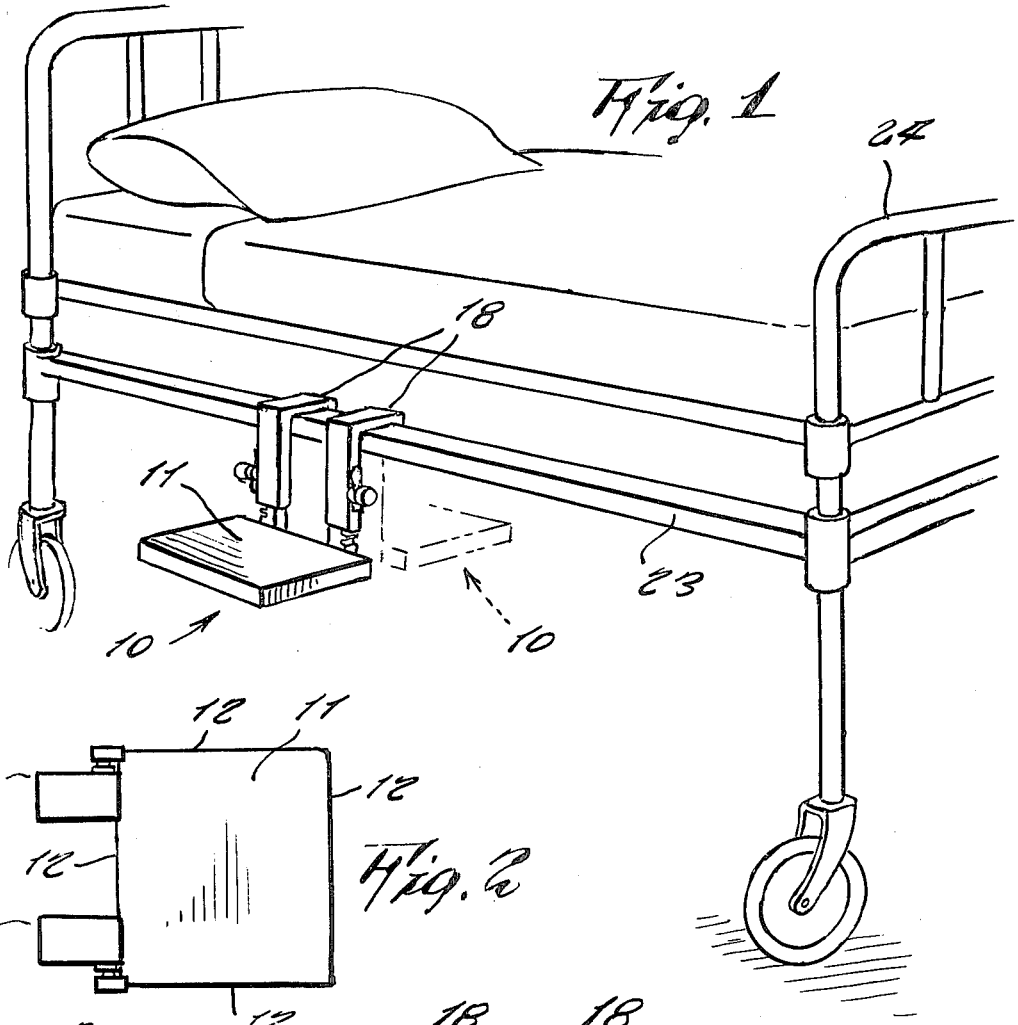
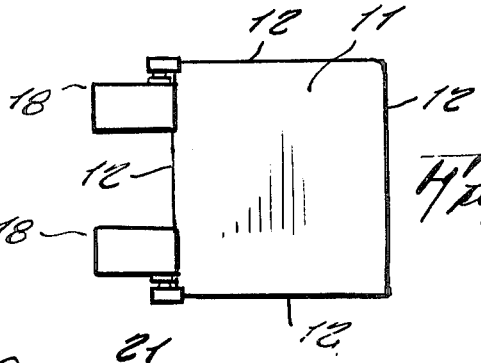
Fig. 2
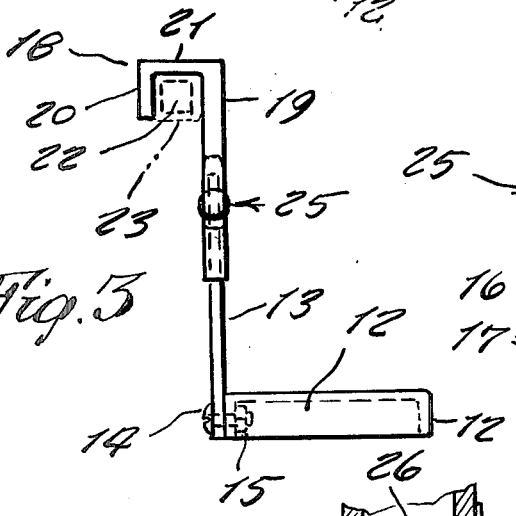
Fig. 3
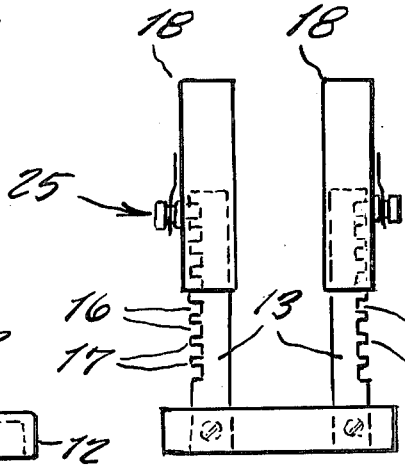
Fig. 4
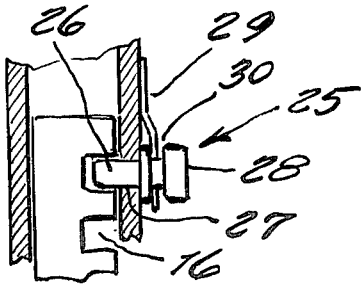
Fig. 5

TRAINING FOOT STOOL

BACKGROUND OF THE INVENTION

This invention relates generally to foot stools. More specifically, it relates to therapeutic devices.

It is well known that many patients who are bed-ridden for a long time, find it difficult later to again resume doing physical activities of even a most simple type, such as just getting in and out of bed, so that they must gradually retrain their muscles again to work.

SUMMARY OF THE INVENTION

It is, therefore, a principal object of the present invention to provide a special foot stool that is designed to aid hospitalized or bed-ridden patients to retrain themselves in just getting in and out of a bed without the assistance of other persons.

Another object is to provide a training foot stool which is adjustable in height, so that as a patient improves in strength, it may be raised so that the muscles are further exercised for additional improvement.

Yet another object is to provide a training foot stool which can be useful also to older persons, pregnant women or even small children in getting in or out of a bed.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING

In the drawing:

FIG. 1 is a perspective view of the invention shown installed on a hospital bed in a utility position, and showing it by dot-dash lines in a stored away position.

FIG. 2 is a top view of the device.

FIG. 3 is a side view.

FIG. 4 is a front view.

FIG. 5 is an enlarged detail of the latch mechanism.

DETAILED DESCRIPTION OF PREFERRED EMBODIMENT

Referring now to the drawing in greater detail, the reference numeral 10 represents a training foot stool according to the present invention, wherein there is a horizontal step plate 11 made of a rectangular steel sheet material, having all four side edges turned down at right angle so as to form stiffener side walls 12. A top surface thereof may be patterned, if wishes, so as to give improved traction against slipping by a foot standing thereupon.

A pair of vertically upward metal bars 13 are secured, spaced apart, to one side wall 12, by means of bolts 14 and nuts 15. Outer side edges of the legs are cut with notches 16 so as to form teeth 17 therebetween.

The upper ends of the legs are inserted into one end of a pair of tubular metal hooks 18, which are bent up into a square shape by having opposite end legs 19 and 20 parallel to each other, and an intermediate leg 21 at right angle thereto, so as to form a rectangular mouth 22 in which a correspondingly cross-sectionally shaped rail 23 of a bet 24 fits.

A detent 25 mounted on each hook includes a pin 26 slideable in a hole 27, so as to selectively engage a notch 16 of the leg. An enlarged head 28 on an outer end of the pin serves to manually pull the pin out of engagement with the notch. A leaf spring 29 affixed at one end, such as by a weld, to the hook, is forked at its other end so as to fit in an annular groove 30 of the pin, the spring serving to retain the pin from slipping out of an engaged notch. In a modified design, the pin and notches may be additionally threaded only at their fully engaged position, such as at pin end and notch bottom, for preventing an unreliable patient from resetting the plate height.

In operative use, as shown by solid lines in FIG. 1, the training foot stool is placed with plate 11 facing outwardly away from a bed, so that a person can use the same for stepping thereupon. It can also serve for sitting thereupon while putting on a shoe or sox.

When not in use, the foot stool can be stored out-of-the-way by turning it around so as to extend in a direction under the bed and support it from the same bed rail, as shown by the phantom lines in FIG. 1.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A training foot stool, comprising in combination, a horizontal plate rigidly affixed to a pair of upward legs, and a pair of tubular hooks in which upper ends of said legs are slidably adjustable; said plate being rectangular, said legs being affixed to one side edge wall of said plate, and said legs beings spaced apart from each other; said hook being shaped by having a mouth that is correspondingly a same as a cross-section of a bed rail; each said leg having a row of notches, and each said hook having a spring-loaded detent pin for selectively engaging said notches; and said pins and said notches being additionally thread-engaged only at their fully engaged position, by a screw thread at an end of said pin and a screw thread at a bottom of said notches.

* * * * *